US011946165B2

(12) United States Patent
Zikeli et al.

(10) Patent No.: US 11,946,165 B2
(45) Date of Patent: Apr. 2, 2024

(54) METHOD AND DEVICE FOR FILAMENT SPINNING WITH DEFLECTION

(71) Applicant: Aurotec GmbH, Regau (AT)

(72) Inventors: Stefan Zikeli, Regau (AT); Friedrich Ecker, Timelkam (AT)

(73) Assignee: AUROTEC GMBH, Regau (AT)

( * ) Notice: Subject to any disclaimer, the term of this patent is extended or adjusted under 35 U.S.C. 154(b) by 247 days.

(21) Appl. No.: 17/271,151

(22) PCT Filed: Aug. 30, 2019

(86) PCT No.: PCT/EP2019/073163

§ 371 (c)(1),
(2) Date: Feb. 24, 2021

(87) PCT Pub. No.: WO2020/043860

PCT Pub. Date: Mar. 5, 2020

(65) Prior Publication Data

US 2021/0189599 A1 Jun. 24, 2021

(30) Foreign Application Priority Data

Aug. 30, 2018 (EP) ..... 18191628

(51) Int. Cl.
*D01D 5/06* (2006.01)
*D01D 5/14* (2006.01)
(Continued)

(52) U.S. Cl.
CPC ..... *D01D 5/06* (2013.01); *D01D 5/14* (2013.01); *D01D 10/06* (2013.01); *D01F 2/00* (2013.01)

(58) Field of Classification Search
CPC ..... D01D 10/06; D01D 5/14
See application file for complete search history.

(56) References Cited

U.S. PATENT DOCUMENTS 4,246,221 A 1/1981 McCorsley, III
4,416,698 A 11/1983 McCorsley, III
(Continued)

FOREIGN PATENT DOCUMENTS

CA 2057133 A1 6/1996
CA 2183230 A1 6/1996
(Continued)

OTHER PUBLICATIONS

Extended European Search Received in European Applicaiton No. 18191628.9 dated Feb. 27, 2019.
(Continued)

*Primary Examiner* — Emmanuel S Luk
(74) *Attorney, Agent, or Firm* — Greer, Burns & Crain, Ltd

(57) ABSTRACT

A method for producing solid cellulose filaments from a fluid of the cellulose by extruding the fluid through a plurality of extrusion openings, whereby fluid filaments are produced, and solidifying the filaments in a coagulation bath, the filaments being bundled in the coagulation bath and being deflected as a bundle in order to be drawn from the coagulation bath above the coagulation bath level, the bundle of filaments assuming a deflection width on a deflecting device, which deflection width is defined in accordance with a formula. A device therefor is also provided.

25 Claims, 9 Drawing Sheets

(51) Int. Cl.
*D01D 10/06* (2006.01)
*D01F 2/00* (2006.01)

(56) References Cited

U.S. PATENT DOCUMENTS

| | | | | |
|---|---|---|---|---|
| 5,216,144 | A | 6/1993 | Eichinger et al. | |
| 5,863,478 | A | 1/1999 | Ruef | |
| 7,270,779 | B2 | 9/2007 | Zikeli et al. | |
| 7,303,710 | B2 | 12/2007 | Zikeli et al. | |
| 7,364,681 | B2 | 4/2008 | Zikeli et al. | |
| 10,208,402 | B2 | 2/2019 | Zikeli et al. | |
| 2004/0051202 | A1* | 3/2004 | Zikeli | D01D 5/06 264/203 |
| 2005/0035487 | A1 | 2/2005 | Zikeli et al. | |
| 2006/0055078 | A1 | 3/2006 | Zikeli et al. | |
| 2006/0083918 | A1 | 4/2006 | Zikeli et al. | |
| 2008/0023874 | A1* | 1/2008 | Fink | D01F 2/00 264/183 |
| 2014/0141111 | A1* | 5/2014 | Glawion | D01D 5/0885 425/69 |
| 2015/0247261 | A1* | 9/2015 | Zikeli | D01D 5/06 425/71 |
| 2021/0189599 | A1 | 6/2021 | Zikeli et al. | |

FOREIGN PATENT DOCUMENTS

| | | | |
|---|---|---|---|
| EP | 1900860 | A1 | 3/2008 |
| KR | 101401148 | B1 | 5/2014 |
| WO | 9428218 | A1 | 12/1994 |
| WO | 9620300 | A2 | 7/1996 |
| WO | 03014432 | A1 | 2/2003 |
| WO | 2008019411 | A1 | 2/2008 |

OTHER PUBLICATIONS

International Search Report and Written Opinion Received in PCT/EP2019/073163 dated Sep. 20, 2019.

Office Action and Search Report received for Russian Federation Patent Application No. 2021107972, dated Nov. 3, 2022.

Office Action received for Finnish Patent Application No. 20195076, dated Jan. 31, 2022.

Office Action received for Taiwan Patent Application No. 108103310, dated Mar. 9, 2022.

Office Action received for Chinese Patent Application No. 201980056832.6, dated Jun. 2, 2022.

* cited by examiner

METHOD AND DEVICE FOR FILAMENT SPINNING WITH DEFLECTION

The present invention relates to the forming and treatment of extruded and subsequently solidified synthetic fibers.

BACKGROUND

Cellulose may be dissolved in aqueous solutions of amine oxides, in particular in solutions of N-methylmorpholine-N-oxide (NMMO), in order to produce spun products, such as filaments, staple fibers, foils and the like, from the resulting spinning solution. This is achieved by means of precipitating the extrudates in water or diluted amine oxide solutions after transferring the extrudates from the extruder into the precipitation bath via a gas gap. Usually, cellulose solutions within a range of 4% to 23% are used for the production of extrusion products. In the further course, the precipitated extrudates in the form of foil or filament strands are forwarded, wherein suitable drawing roller mills provide the required stretching forces (in the gas gap). This method is also referred to as lyocell method, and the cellulose filaments thus obtained are correspondingly referred to as lyocell filaments.

Document U.S. Pat. No. 4,416,698 relates to an extrusion and spinning method for cellulose solutions in order to form cellulose filaments. In this method, a fluid spinning material—a solution of cellulose and NMMO (N-methylmorpholine-N-oxide) or other tertiary amines—is formed by extrusion and transferred to a precipitation bath for solidification and expansion.

Documents U.S. Pat. No. 4,246,221 and DE 2913589 describe methods for producing cellulose filaments or foils, wherein the cellulose is stretched in a fluid form.

Document WO 94/28218 A1 describes a method for producing cellulose filaments, wherein a cellulose solution is formed into a plurality of strands using a nozzle. Through a gas circulation gap, said strands are then transferred to a precipitation bath where they are continuously leached.

Document CA 2057133 A1 describes a method for producing cellulose fibers, wherein a spinning mass is extruded and introduced via an air gap into a cooled NMMO-containing water bath.

Document WO 03/014432 A1 describes a precipitation bath with a central fiber discharge device arranged underneath a cover sheet.

Document EP 1 900 860 A1 describes a two-step coagulation bath of a spinning device, wherein the baths may have different $H_2SO_4$ compositions.

Document WO 97/33020 A1 relates to a method for producing cellulosic fibers, in which a solution of cellulose in a tertiary amine oxide is extruded through spinning holes of a spinning nozzle, the extruded filaments are guided through an air gap, a precipitation bath and across a drawing gear by means of which the filaments are stretched, and the stretched filaments are processed to form cellulosic fibers, wherein during processing the stretched filaments are subjected to a tensile load of not more than 5.5 cN/tex in a longitudinal direction.

Document DE 10200405 A1 describes a lyocell device having a blowing device arranged in the gas gap. Mentioned therein is a precipitation bath device, in which a filament curtain is immersed in the precipitation bath, is deflected in the precipitation bath and leaves the precipitation bath in a slanting upward direction to be transferred to a bundling device. As single-strand bundling is applied here, a strong bundling is to be expected in the deflection process.

Document WO 02/12600 describes a spinning method in which the maximum economic spinning speed may be calculated using a formula based on fiber titer, spinning hole row number and a variable operating parameter.

Document WO 02/12599 describes a spinning method in which a filament curtain is deflected in a coagulation bath and is subsequently merged in a point-shaped manner.

Document WO 96/20300 describes deflection angles of filaments in the lyocell method calculated according to a formula.

The problem of causing damage to the filaments in the drawing process is addressed in WO 2008/019411 A1 and is solved with the aid of a mechanical drawing gear which is arranged in the spinning bath, wherein said drawing gear is also supposed to provide part of the drawing forces acting during operation. Besides the sheer complexity of the construction, it is a further notable disadvantage that individual, very fine filaments may become entangled in the mechanical construction and may thus functionally impair both the spinning process and the mechanical device itself.

Document WO 2014/057022 describes serial spinning baths comprising different media.

SUMMARY

In the currently applied lyocell methods, all single filaments (single extrudates) which directly abut the deflection device (such as a rod) are pressed against the deflection device by the normal forces resulting from the tensile force of the whole bundle. Due to the frictional resistances, this may lead to tear-offs and filament rupture. In particular in case of strong bundling, the high normal force resulting from the total drawing force is exerted on only a few single filaments which are in direct contact with the deflection device. These few single filaments may be seriously damaged by the high frictional load, in particular at high drawing speeds. This is aggravated by the fact that the filaments in the coagulation bath are swollen and potentially still at a high temperature, which reduces their mechanical strength.

It is thus an object of the present invention to minimize the frictional load that is exerted on each single filament at deflection points and thus to facilitate higher productivity and higher spinning speeds. Such frictional forces occur in spinning baths in which the medium employed requires the use of rigid deflection devices or of deflection devices with driven or freely rotating rollers, such as e. g. in a filament drawing gear.

The present invention allows for computationally evaluating a system with respect to the frictional load exerted on the filaments as well as for determining suitable measures for adjusting the system in such a manner that the frictional load exerted on all filaments that are in direct contact with the deflection device can be maintained at a minimum level.

It is a further object of the present invention to ensure manual manageability of the filament curtain and accessibility of the deflection point in the treatment zone between spinning nozzle and drawing gear without the necessity of using highly complex and delicate splicing aids or drawing gears.

The present invention provides a method for producing solid cellulose filaments from a cellulosic fluid, the method comprising the steps of extruding said fluid through a plurality of extrusion openings, whereby fluid filaments are formed, preferably passing said fluid filaments through a gas gap, and solidifying said filaments in a coagulation bath, wherein the filaments are bundled and deflected as a bundle in the coagulation bath in order to be drawn from the coagulation bath above the coagulation bath level, wherein the bundle of filaments occupies a deflection width L on a deflection device, the deflection width L being controlled according to Formula 1:

$$L>(2\times LZ\times\cos(B/2)\times v^{2,5})/(10\times c_{cell}^{0,5}\times Q) \quad \text{Formula 1,}$$

wherein L is the deflection width of the bundle in mm, LZ is the number of extrusion openings, B is the deflection angle (calculated as 180° minus the wrap angle of the filaments around the deflection device in angular degrees), v is the drawing speed of the filaments in meters per second, $c_{cell}$ is the cellulose concentration of the extruded fluid in % by mass, and Q is a dimensionless load number, with Q being 15 or lower. In Formula 1, ">" has the meaning of "greater than", "x" is a multiplication sign and "cos" refers to the cosine.

The present invention further relates to a device that is suitable for conducting said method, the device comprising an extrusion plate having a plurality of extrusion openings, a collection container for taking up a coagulation bath, preferably a gas gap arranged between the extrusion openings and the collection container, a deflection device arranged in the collection container for deflecting a filament bundle from the collection container, and a bundling device which determines a deflection width L occupied by the filament bundle on the deflection device, wherein the filament bundle occupies a deflection width L corresponding to the above-mentioned Formula 1 on the deflection device, wherein L, LZ, B, v, $c_{cell}$ and Q are as defined in the above, Q is 15 or lower and v is at least 35 m/min, according to which the device is thus adapted.

According to the present invention, there are usually large deflection widths L; the present invention thus also relates to a method for producing solid cellulose filaments from a cellulosic fluid, the method comprising the steps of extruding said fluid through a plurality of extrusion openings, whereby fluid filaments are formed, preferably passing said fluid filaments through a gas gap, and solidifying said filaments in a coagulation bath, wherein the filaments are bundled and deflected as a bundle in the coagulation bath in order to be drawn from the coagulation bath above the coagulation bath level, wherein the extrusion openings are arranged within a length LL and the bundle of filaments occupies a deflection width L on a deflection device which is at least 70% of the length LL. Analogously, the present invention also relates to a device that is suitable for conducting said method, the device comprising an extrusion plate having a plurality of extrusion openings, a collection container for taking up a coagulation bath, preferably a gas gap arranged between the extrusion openings and the collection container, a deflection device arranged in the collection container for deflecting a filament bundle from the collection container, and a bundling device which determines a deflection width L occupied by the filament bundle on the deflection device, wherein the extrusion openings are arranged within a length LL and the bundle of filaments occupies a deflection width L on the deflection device which is at least 70% of the length LL.

The following detailed description relates to devices and methods in equal measure, i. e. preferred method features also correspond to properties or the suitability of the device and/or the respective components thereof, and preferred device features also correspond to means that are employed in the method according to the present invention method. All preferred features may be combined, unless explicitly stated otherwise. All method features, including the above-mentioned, may be combined. All device features, including the above-mentioned, may be combined.

DETAILED DESCRIPTION

Figure 1:
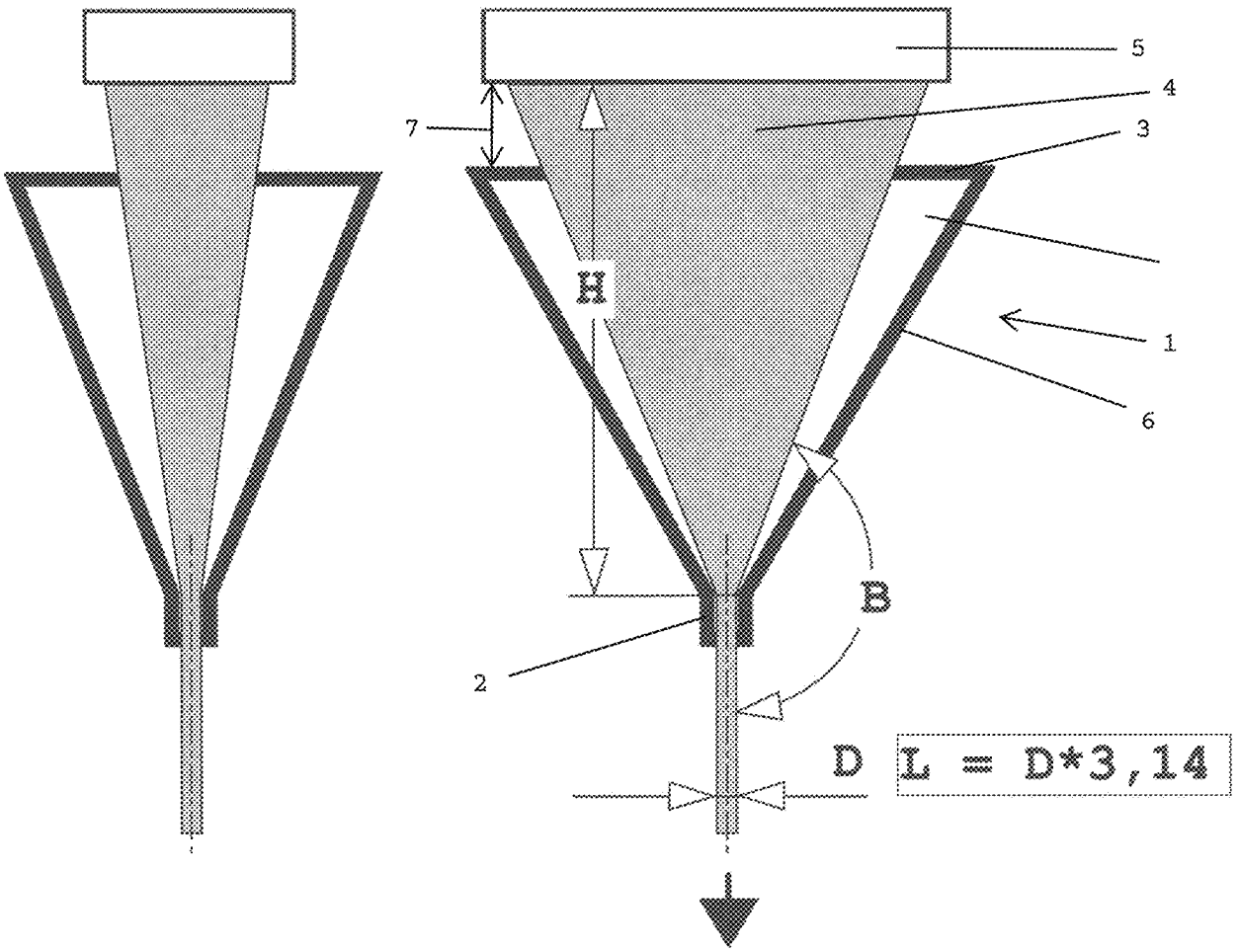
FIG. 1 shows a liquid treatment zone in the form of a spinning funnel (6).

The present invention relates to the deflection of filament curtains or at least unilaterally bundled filament bundles. The deflection is performed in the coagulation bath in order to convey the filaments out of the bath. In the deflection process, the filaments are merged perpendicularly to the deflection axis, such that the filaments in the first layer rest on a deflection device and the filaments in the other layers rest one layer upon one another. As already mentioned, this exerts a certain stress on the material, in particular at high speeds. According to the present invention, the deflection width was enlarged in order to enable the drawing of filaments at arbitrary, i. e. also high, speeds of, e. g., 35 m/min or higher.

In the deflection process according to the present invention, the filaments are guided in the form of a broad band. The term "filament bundle" thus includes bands of jointly guided filaments having a cross-sectional width and height, wherein the width is greater than the height.

The above Formula 1, with Q=15 or lower, in particular relates to a deflection process performed in the coagulation bath, in which the filaments are particularly susceptible to the frictional forces as mentioned in the summary due to temperature and swelling conditions. The coagulation bath represents part of the treatment zone for the extruded filaments. According to the lyocell method, the filaments have not yet obtained their final structure and stability at this point. Initially, structure and stability vary due to stretching (especially in the gas gap) and a solvent exchange (especially in the coagulation bath). Material changes may still occur after withdrawal from the coagulation bath, so that the path covered by the filaments/extrudates between the exit from the spinning nozzles and the step of washing the solvent out of the filaments/extrudates, including a drawing gear, is referred to as treatment zone. As the extruded filaments have not yet obtained their final form, they are referred to as "extrudates" while still in the treatment zone. A drawing gear is a device which provides the deformation forces that are required for filament formation as well as the frictional forces acting on the filaments/extrudates during the transport from the spinning nozzles to the drawing gear. Due to the hydrodynamic conditions prevailing in the coagulation bath, there is a very high risk of entanglements with the use of driven or freely rotating deflection devices, so that the use of fixed deflection devices is preferred within the coagulation bath. Outside the coagulation bath, however, fixed deflection devices should possibly provide only a slight deflection or freely rotating and/or driven deflection devices should be used. With the use of freely rotating and/or driven deflection devices, the filaments/extrudates will be less susceptible to frictional effects, so that also smaller deflection widths L, as calculated according to Formula 1, may be employed. However, a certain width will still be maintained, in particular for the deflection process at the drawing gear, as frictional effects also occur here. Depending on the throughput (per extrusion opening), the drawing gear ensures provision of the required drawing speed. A drawing gear transfers the drawing speed to the filaments/extrudates by means of driven deflection devices or a plurality of deflection devices, such as reels or rollers. In this instance, the deflection force of the reel is initially transferred to the inner filaments/extrudates (in direct contact with the reel/roller), which in turn transfer said force to the outer filaments/extrudates (not in direct contact with the reel/roller). Thus, there is a greater strain on the inner filaments/extrudates than on the outer filaments/extrudates. This imbalance is minimized according to the present invention by maintaining a deflection width to such an extent that the inner filaments/extrudates will only be covered by a limited number of outer filaments/extrudates, thus maintaining swift and efficient operation. The extrusion openings may be bores or holes, as well as capillaries, provided in an extrusion plate. For all these instances, the number of extrusion openings will be referred to as hole number. The drawing process may be performed in a gas compartment, into which the filaments are introduced upon exiting the coagulation bath.

According to the present invention, a deflection device is a machine part which enables a change in direction of individual extrudates, of extrudate curtains or of extrudate bundles, wherein the deflection width L of the deflected curtain itself is preferably not influenced by the deflection device.

In principle, such deflection devices may also be implemented as rigid deflection devices or rotating deflection devices. Rotating deflection devices may or may not be driven. Rotating deflection devices offer the advantage of a reduction in frictional forces between extrudate and deflection device and the deflection may thus be performed in a very gentle manner—except in case of a deflection in a drawing gear, when forces are transferred from the deflection device to the filaments/extrudates. It is, however, a disadvantage of rotating deflection devices that individual extrudates may adhere to the rotating deflection device due to their stickiness, thus potentially causing entanglements, tear-offs and other malfunctions. The use of rotating deflection devices is also problematic in liquids (in the coagulation bath), as hydrodynamic vortices in the surface area of the deflection device pose a high risk of dragging individual extrudates along the circumference of the deflection device, again potentially causing entanglements, tear-offs and other malfunctions.

With spinning bath liquids, but also with sticky, wet or otherwise adhering extrudate curtains or bundles, the use of rigid deflection devices is preferred, e. g. in the form of rods, spools, cage-shaped deflection devices or any other suitable form.

Any materials having lowest possible slide friction values may be considered as materials for rigid deflection devices. Besides metals (either coated or uncoated), textile ceramics or synthetic materials may also be considered.

A deflection device is preferably employed in the coagulation bath. Also possible is the provision of two or more deflection devices in the coagulation bath, thereby increasing the number of options for (greater) deflection angles B per deflection device. According to the present invention, the requirements according to Formula 1 are met by the first, preferably also the second or also every deflection device in the coagulation bath. In this context, "first", "second" etc. refers to the respective procedural proximity to the extrusion process and to the order in which the filaments/extrudates pass the deflection devices.

Also subsequently to the coagulation bath in the treatment zone, the filaments/extrudates are kept in the form of a band having a certain deflection width, as also at this point, in particular in a drawing gear, frictional forces are exerted which could cause damage in the deflection process. Subsequently to the coagulation bath, however, the deflection width may be kept narrower than in the coagulation bath itself, as the negative effects on filament stability due to temperature and swelling may be less pronounced here. According to the present invention, the deflection process outside the coagulation bath is preferably conducted with at least a deflection width $L_{outside}$, which corresponds to L according to Formula 1 (with Q 15) divided by 30, preferably divided by 20, preferably divided by 10 and particularly preferably divided by 5, and/or the filament bundle is preferably kept at said width $L_{outside}$ (also between deflection processes)—at least up to the point of entering a drawing gear and/or a washing device. Alternatively, $L_{outside}$ may be calculated according to Formula 1, wherein Q can have a higher value, e. g. with Q=up to 300 or up to 250, such as 10 to 300 or 40 to 250. In a washing device, the filament bundle is usually fanned out even more broadly in order to facilitate the washing process. $L_{outside}$ can also be at least L according to Formula 1 (with Q up to 15), e. g. in the washing process.

$L_{outside}$ (deflection or band width outside the coagulation bath) may also be defined independently of L according to Formula 1. $L_{outside}$ will preferably be selected such that a filament density per mm deflection width of not more than 7,000 dtex/mm, preferably of not more than 6,000 dtex/mm, not more than 5,000 dtex/mm and particularly preferably of not more than 4,000 dtex/mm, is achieved at a given drawing speed.

Said deflection or band width outside the coagulation bath, $L_{outside}$, is preferably maintained in the immediately subsequent deflection process conducted after the filaments/extrudates have been withdrawn from the coagulation bath, when the filaments/extrudates are still very delicate, and/or maintained in the drawing gear, when the filaments/extrudates are particularly stressed by the transmission of forces. Upon exiting the coagulation bath and during their passage through the entire treatment zone or during the entire processing of the filaments/extrudates, the filament bundles are preferably always kept at a minimal width $L_{outside}$ until the final products will be cut and/or reeled. Processing usually includes the following steps: spinning in a coagulation bath (as described above), withdrawal from the coagulation bath, drawing by means of a drawing gear, washing, drying, reeling and/or cutting the filaments as final products.

A spinning method, including processing, may alternatively or additionally comprise the following steps: extruding the filaments/extrudates through a spinning nozzle, guiding the filaments/extrudates through a gas gap (into which preferably a gas stream is injected, see supra) into a coagulation bath (precipitation bath), deflecting the filaments/extrudates in the precipitation bath, preferably by means of a deflection device arranged opposite the spinning nozzle, withdrawal of the coagulated filaments/extrudates from the coagulation bath, deflecting the filaments/extrudates outside the coagulation bath and without any further bundling with other coagulated filaments/extrudates, feeding the filaments/extrudates onto a drawing gear (also referred to as drawing apparatus or drawing device) and/or stretching device and subsequently conveying the filaments/extrudates to a filament reception unit and/or stretching gear, washing, drying and optionally other steps, as desired. The device according to the present invention is provided with the corresponding equipment. In another embodiment, the method can include the following steps: extruding the filaments/extrudates through a spinning nozzle, guiding the filaments/extrudates through a gas gap (into which preferably a gas stream is injected, see supra) into a coagulation bath, deflecting the filaments/extrudates outside the coagulation bath and subsequently bundling or merging them with other filaments/extrudates, feeding the filaments/extrudates onto one or more drawing gears, washing, drying and optionally other steps and/or devices, as desired.

Some of the steps can be combined; for instance, a washing step may be performed in the drawing gear. The embodiments, as described in detail or preferred herein, can be employed in each of the steps. It is also possible to combine driven and non-driven rollers or reels in one drawing gear, as has been described, e. g., in document CN 105887226 (A). A heat treatment, such as drying, as has been described, e. g., in CN 205133803 U, may also be conducted in the drawing gear. In the start-up phase of the method, a splicing aid, as described, e. g., in CN 205258674 U, may be employed; however, this is only an auxiliary step and is not essentially required.

Other steps or devices suitable for the purposes according to the present invention may be provided. For instance, a drying step may be performed subsequently to the washing step, or a drying device may be provided downstream of the washing device, wherein prior to the drying process or upstream of the drying device one or more other treatment steps, such as finishing the filaments/extrudates, may be conducted or a corresponding finishing device may be provided. Furthermore, other process steps, such as dyeing, cross-linking, sonication, may be conducted prior to the drying step, i. e. correspondingly suitable devices may be provided.

At any point in the process up to the drying step, a cutting device (for cutting) or a reeling device (for reeling) may preferably be interposed in order to produce staple fibers or continuous yarns from the continuous fibers.

Preferably, a tensile force of less than or equal to 3 cN/dtex, preferably of less than or equal to 2 cN/dtex or of less than or equal to 1.5 cN/dtex is exerted on the filaments/extrudates in the drawing gear.

The filament bundles of a plurality of spinning points may be combined to form a combined bundle. Usually, such a combination is performed (immediately) upon exiting the coagulation bath, such that the downstream plant components, like drawing or washing devices, are able to process the combined bundle. The width L or $L_{outside}$ is herein mostly given with reference to one spinning point and increases correspondingly upon combination. For instance, $L_{outside}$ can be at least 8 mm, e. g. 8 mm to 100 mm and preferably 12 mm to 70 mm, per spinning point.

The bundling device represents a machine part which narrows the deflection width of the extrudate curtain depending on the geometric shape of the bundling device, thereby forming an extrudate bundle from a plane or tubular or also round or otherwise shaped extrudate curtain. Optionally, the bundling device also enforces a change in direction of the formed extrudate bundle. The bundling device may thus also represent a deflection device which is subject to the rules and preferred embodiments according to the present invention. Analogously to the description of the deflection device, bundling devices may be implemented as rigid or rotating devices. Identical materials may be used. For the use in spinning bath liquids, but also in the presence of sticky, wet or otherwise adhesive extrudate curtains or bundles, rigid bundling devices in the form of rods, spools, cage-shaped deflection devices, hooks, loops, U-shaped guides or devices of any other suitable design will preferably be employed.

The load factor Q is an empirical measure of the filaments layered on top of one another at the deflection device. The lower Q, the gentler the method and the larger L has to be selected. In the coagulation bath, Q should be 15 or lower, preferably Q is 12 or lower, preferably 8 or lower or 5 or lower. In connection herewith, Q is 2 or higher, preferably 3 or higher or 4 or 5 or higher, wherein particularly preferably Q is from 2 to 15 or more preferably from 4 to 12. Possible values for Q are 2, 3, 4, 5, 6, 7, 8, 9, 10, 11, 12, 13, 14, 15 or any other value in between. As already mentioned above, Q may be higher outside the bath. In this instance, L is exchanged for $L_{outside}$, with Q being up to 300. Unless explicitly stated otherwise, Q refers to a deflection process conducted in the coagulation bath.

The number of extrusion openings (also referred to as hole number and abbreviated as "LZ") determines the number of filaments which have to be deflected. The method according to the present invention is, in particular, dimensioned for the large, industrial scale. The number of extrusion openings LZ preferably is 2,000 or more, preferably 5,000 or more or 10,000 or more. Either independently or in combination, LZ may be 500,000 or less, preferably 200,000 or less, 100,000 or less or 50,000 or less. If a simultaneous production of larger product amounts and thus of a higher number of filaments is required, a plurality of extrusion devices according to the present invention may be employed in order to produce a plurality of parallel filament bundles or curtains, optionally in a jointly used coagulation bath or even with the joint use of one deflection device. The above-mentioned hole numbers refer to a bundle or a group of filaments being jointly deflected and bundled.

The deflection angle B is determined by the angle enclosed by filaments which are transferred to the deflection device and the deflected filaments (see the Figures). A sharper angle will result in stronger shearing and frictional forces acting on the filaments. The sharper the angle, the more L has to be increased (while the other parameters of Formula 1 remain constant). Preferably, the deflection angle B is an angle of 10° to 90°, preferably of 20° to 60° or of 25° to 45°. Unless explicitly stated otherwise, the angle B refers to a deflection process conducted in the coagulation bath. Outside the coagulation bath, e. g. in a drawing gear and/or washing device, the deflection angle can be 0° to 150°, in particular any angle within said range, as has already been indicated, e. g., for the angles in the coagulation bath.

According to the present invention, the large deflection widths L allow for high drawing speeds. The filaments are drawn through the coagulation bath, generally with the aid of a drawing gear. The drawing gear itself is generally arranged outside the coagulation bath, downstream of the deflection device and optionally also of the bundling device. A corresponding deflection width L is selected depending on the drawing speed. Preferably, the drawing speed (at the deflection device) is at least 35 m/min. The drawing speed v may be 36 m/min or higher, preferably 40 m/min or higher or 45 m/min or 50 m/min or higher. Independently or in combination, the drawing speed v may be 200 m/min or lower or 150 m/min or lower.

In the method according to the present invention, an extrusion medium is used as a fluid. Said fluid preferably is a solution or a mixture of cellulose and other medium components, such as solvents. The cellulose concentration is selected as is conventional for lyocell methods. Thus, the cellulose concentration of the extruded fluid $c_{cell}$ may be 4% to 23%, preferably 6% to 20% and in particular 8% to 18% or 10% to 16% (all percentages refer to % by mass). The extrusion medium employed in the lyocell method usually is a cellulose solution or melt with NMMO (N-methylmorpholine-N-oxide) and water, as mentioned in the introduction. Other solutions of cellulose, in particular ionic solvents of cellulose, may also be employed. Ionic solvents are, for example, described in document WO 2006/000197 A1 and preferably contain organic cations, such as ammonium, pyrimidium or imidazolium cations, preferably 1,3-dialkylimidazolium halogenides. Also in this instance, the use of water as a solvent additive is preferred. Particularly preferred is a solution of cellulose and butyl-3-methylimidazolium (BMIM), e. g. with chloride as a counter ion (BMIMCl), or 1-ethyl-3-methylimidazolium (also preferably as a chloride) and water.

The step of passing the fluid filaments through a gas gap in the method according to the present invention or the provision of the gas gap according to the present invention device is optional, i. e. a gas gap may or may not be provided. This step/measure distinguishes between a wet spinning and a dry-wet spinning process. In case of wet spinning, the filaments are directly introduced into the coagulation bath. In case of dry-wet spinning, the gas gap is provided and the filaments pass through it prior to being introduced into the coagulation bath.

Optionally, a gas stream may (and preferably will, in particular in large, industrial-scale plants) be injected into the gas gap, to which end a blower is provided in the device. The injected gas stream preferably has a temperature of 5° C. to 65° C., preferably of 10° C. to 40° C. The fluid material may be extruded at a temperature of 75° C. to 160° C. Preferably, the gas gap is kept at a lower temperature than the extruded fluid material. In particular, a gas stream in the gas gap will be kept at a lower temperature than the extruded fluid material.

The gas gap itself, i. e. the distance between the extrusion openings and the coagulation bath, and/or containers suitable for this purpose, such as a tank, may preferably have a length of between 10 mm and 200 mm, in particular between 15 mm and 100 mm, or between 20 mm and 80 mm. Preferably, said length is at least 15 mm. The gas present in the gas gap is preferably air. The gas stream preferably is an air stream, while the use of other inert gases is also possible. The term "inert gas" refers to a gas that does not undergo a chemical reaction with the fluid filaments in the gas gap, and preferably neither with the coagulation medium, such as water or a diluted, aqueous NMMO solution or other solvent components, depending on the extrusion medium employed.

In a wet spinning method, the treatment zone will substantially consist of liquid containers, liquid funnels or liquid channels. The extrudates discharged from the spinning nozzle are directly introduced into the spinning bath liquid for precipitating and/or cooling. The wet (precipitated and/or cooled) extrudates are then transferred to washing baths and/or—through a gas or air compartment—to the drawing gear.

In a dry-wet spinning method, the treatment zone will substantially consist of a gas or air gap and downstream liquid containers, liquid funnels or liquid channels. The extrudates discharged from the extrusion openings pass a gas gap and, in the further course, a coagulation bath, which is also referred to as spinning bath. The wet (precipitated and/or cooled) extrudates are transferred to the drawing gear through one or more washing baths and/or through a gas or air compartment.

The wet or dry-wet spinning method is characterized by the occurrence of turbulences and vortices owing to displacement and dragging interactions between the coagulation bath liquid and the extrudates occurring at higher speeds. With the use of deflection points with rigid deflection devices, there is also an additional run-dry risk at the points of contact between extrudate and deflection device. Said run-dry risk will increase proportionally to the drawing speed and to the amount of pressure exerted on the extrudate curtains or bundles thereof, which is pressing the latter against the deflection device.

The extrusion openings are preferably arranged in a longitudinal shape in order to form the extruded filaments in a geometry that is favorable for deflection and bundling in the deflection process. Thus, the longitudinal arrangement of the extrusion openings preferably also corresponds to a longitudinal direction of the deflection device. Said longitudinal direction of the deflection device thus preferably corresponds to a deflection axis (or, with the use of curved deflection devices, follows a plurality of deflection axes). The extrusion openings may be arranged in a rectangular, curved, annular or ring segment-shaped manner. The longitudinal form may have a ratio of length to width from 100:1 to 2:1, preferably from 60:1 to 5:1 or from 40:1 to 10:1.

The extrusion openings preferably have a diameter of 30 μm to 200 μm, preferably of 50 μm to 150 μm or of 60 μm to 100 μm, thus facilitating the production of filaments suitable for (woven and non-woven) textile products.

The extrusion throughput will preferably be adjusted to yield a linear density of the resulting single fibers of 1.3 dtex±50%, preferably ±25% or ±10%, at a given drawing speed. The extrusion throughput can be adjusted by regulating the pressure of the extruded mass, i. e. the cellulose solution. Examples for possible pressures are 5 to 100 bar or preferably 8 to 40 bar.

An overall large deflection width L is particularly preferred, also in the sense of a discrete main feature of the present invention and independently of Formula 1. Either depending on Formula 1 or independently thereof, the extrusion openings may be arranged along a length LL, wherein according to this feature of the present invention the deflection width L is at least 70%, preferably at least 80% or also at least 90% of the length LL. The deflection width may also be equivalent to the length LL or even larger, such as 110% of the length LL or more. $L_{outside}$ is preferably at least 1%, at least 3%, preferably at least 5% or also at least 10% of the length LL. For the purpose of bundling, $L_{outside}$ will preferably be a maximum of 50% of the length LL. All method parameters and pertaining device settings according to the present invention may be combined. For instance, a particularly preferred combination would be a drawing speed v of 40 m/min to 150 m/min and a load factor Q of 4 to 13 or of 5 to 12. All values described herein, either within or outside these ranges, are of course also possible.

EXAMPLES

The liquid treatment zone in a dry-wet spinning method may be implemented in a number of variants, some of which are described in FIGS. 1, 2*a*, 2*b*, 2*c*, 3*a* and 3*b*. The respective experimental parameters and results are indicated in Table 1, supra:

FIG. 1 shows a first embodiment of the liquid treatment zone in the form of a spinning funnel. In this variant, the spinning bath liquid is fed into a funnel-shaped container (6) via a feeding point (1). The funnel-shaped container (6) has a bottom opening in its lower portion. Via a bundling device (2), which is inserted in the bottom opening, a portion of the supplied spinning bath is discharged together with the extrudates (4) passed through the spinning funnel from top to bottom. The excess portion of the spinning bath is discharged via an overflow edge (3). The overflow edge (3) also serves for adjusting the air gap (7). The extrudates discharged from the spinning nozzle (5) are bundled vertically downwards and are discharged from the spinning funnel via a bundling device (2). The cross-section of the bundling device (2) may be round, oval, polygonal or slit-shaped.

A deflection angle (B) is derived from the normal distance (H) between nozzle discharge (5) and bundling device (2) as well as the given geometric ratios of the nozzle (5). The deflection width (L) represents the portion of the deflection device with which the extrudates are actually in contact and at which they are deflected and/or bundled. With the use of a torus-shaped bundling device (2), the deflection width (L) is derived from the product of bundling diameter (D) and the number Pi (3,1415 . . . ). The deflection angle (B) is derived from the respectively selected geometric ratios. The minimum required deflection width (L) is calculated according to Formula 1.

FIGS. 2*a*, 2*b*, 2*c*, 3*a* and 3*b* show a liquid treatment zone implemented as a spinning tank. In these variants, the spinning bath liquid (coagulation liquid) is fed into an arbitrarily tank-shaped container (8) via a feeding point (1). The liquid is discharged from the container via an overflow edge (3). The overflow edge (3) also serves for adjusting the air gap (7). A deflection device (2) and/or optionally a bundling device is/are arranged inside the spinning tank (8). The extrudates (4) discharged from the spinning nozzle (5) are fed into the tank (8) vertically downwards. The extrudates (4) are deflected, and, if necessary, also bundled, at the deflection device (2) arranged in the spinning bath tank, are discharged from the spinning bath in an upward direction and are fed to the subsequent treatment steps. The deflection or bundling device may be implemented with a round, oval or polygonal cross-section. For instance, a deflection device may also be a cage or rod roller consisting of a plurality of rods; the use of a deflection roller having ridges arranged horizontally to the extrudate conveying direction is also possible. According to another embodiment, the deflection device (2) may also be implemented concavely in an axial direction in order to affect not only the deflection of the extrudates (4), but also the bundling thereof to form an extrudate strand. As the use of rotating elements in the spinning bath liquid will invariably lead to turbulences in the spinning bath and thus in the further course also to entanglements, tear-offs and other malfunctions, the deflection devices arranged in the spinning bath are, in general, preferably implemented as rigid deflection devices.

The normal distance (H) between nozzle discharge (5) and bundling device (2) is adjusted such that the nozzle draft angle will have a value of less than 45°, less than 30°, less than 15° or preferably less than 10°. This measure ensures that the extrudates can be drawn from the nozzle channel gently and with a minimum deflection. Depending on the normal distance (H) and the nozzle draft angle, the deflection angle (B) will emerge at given geometric ratios. The deflection width (L) represents the longitudinal portion of the deflection device with which the extrudates are in direct contact and by which they are deflected and/or bundled; in case of a curved (concave) deflection device, the deflection width (L) represents the stretched length of the contact line occupied by the extrudates. The deflection angle (B) is derived from the respectively selected geometric ratios. The minimum deflection width (L) is calculated according to Formula 1.

Figure 2A:
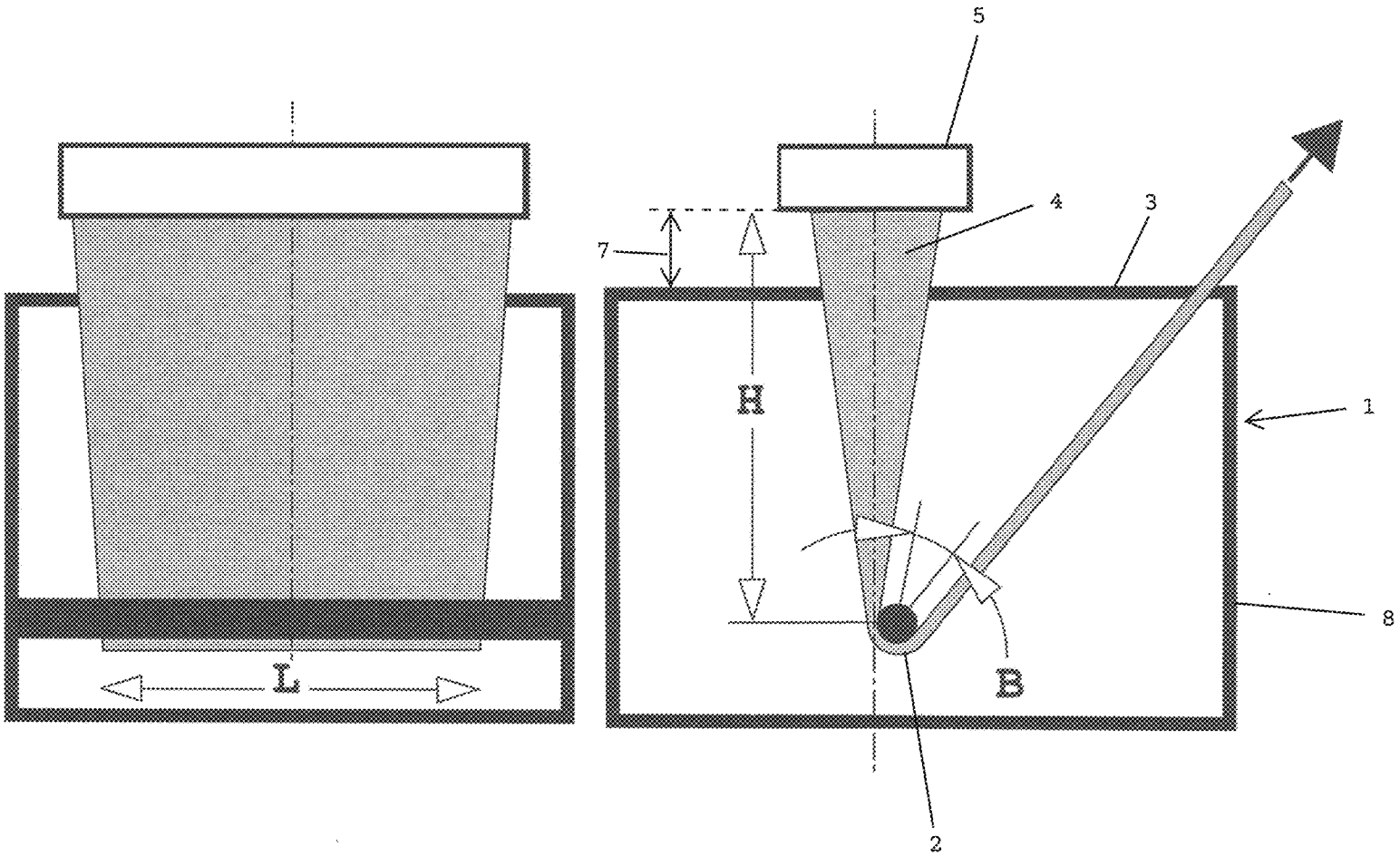
FIG. 2*a* shows a spinning tank system in combination with a rectangular spinning nozzle arrangement.

FIG. 2*a* shows a spinning tank system in combination with a rectangular arrangement of extrusion openings (at the extruder, spinning nozzle). Typical for the tank system with a rectangular nozzle arrangement are rather small deflection angles (B) with a large deflection width (L).

Figure 2B:
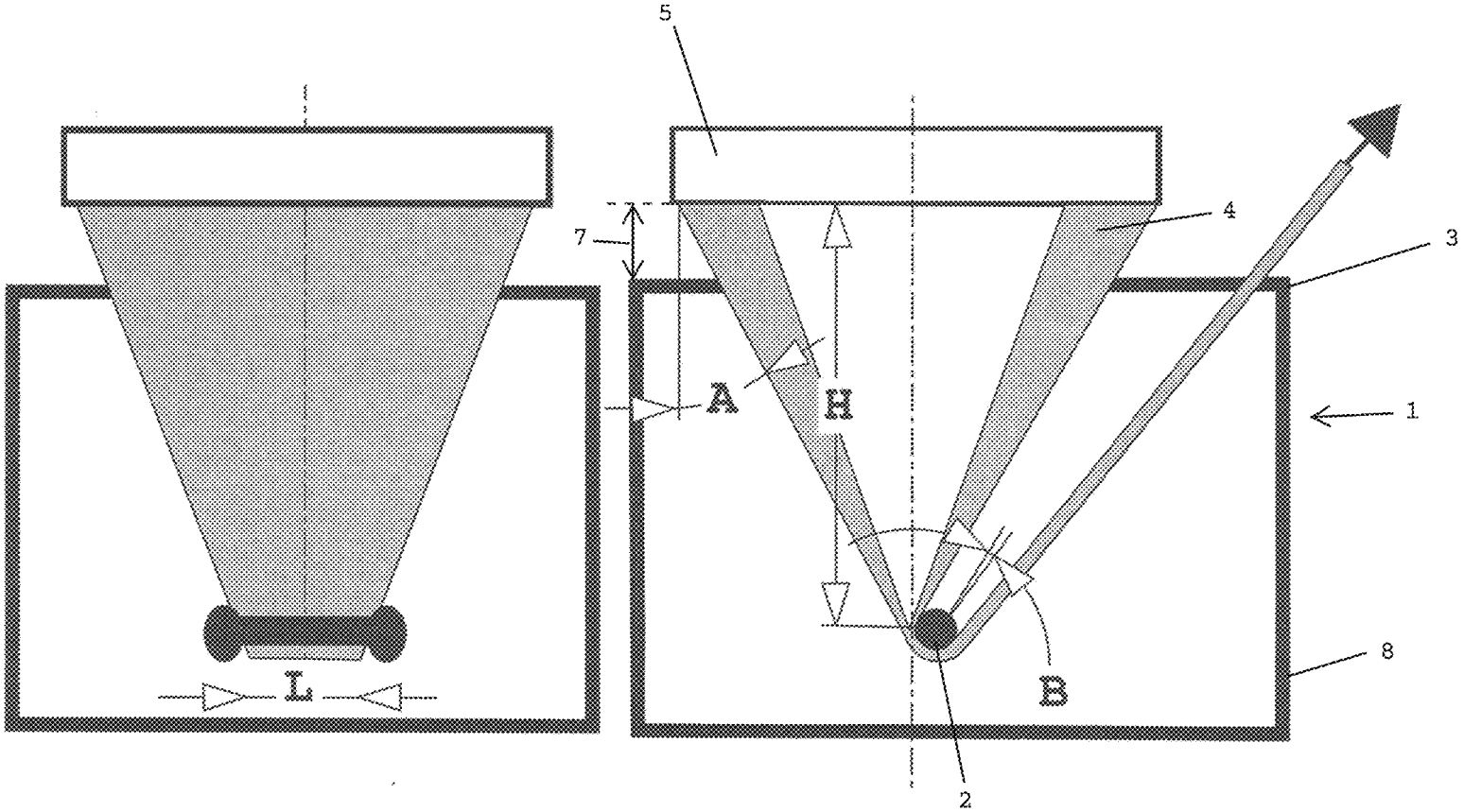
FIG. 2*b* shows a spinning tank system in combination with an annular spinning nozzle arrangement (5) and a straight deflection device (2).

FIG. 2*b* shows a spinning tank system in combination with an annular arrangement of extrusion openings. In contrast to the system with a rectangular nozzle arrangement (FIG. 2*a*), this embodiment has disadvantages. Compared to the rectangular nozzle arrangement according to FIG. 2*a*, the nozzle draft angle is substantially larger, owing to which the process of drawing the extrudates from the nozzle channel can no longer be conducted gently. In particular with the use of large diameters of the annular nozzle arrangement, a substantial increase of the normal distance (H) between nozzle and deflection device is thus required. As the required normal distance (H) may easily be as large as 1 meter in case of large annular nozzle arrangements, the manual accessibility of the deflection device is impaired—in addition to which the strong frictional forces acting between the extrudates and the coagulation bath have a negative effect on the total tension in the filament bundle. It is another disadvantage of the embodiment according to FIG. 2*b* that with the use of an annular nozzle arrangement not only the deflection process, but also the bundling process must be carried out in the spinning bath in order to provide identical conditions for all annularly arranged extrudates. Typical for the tank system with an annular nozzle arrangement and central bundling in the spinning bath are rather small deflection angles (B) with a small deflection width (L).

Figure 2C:
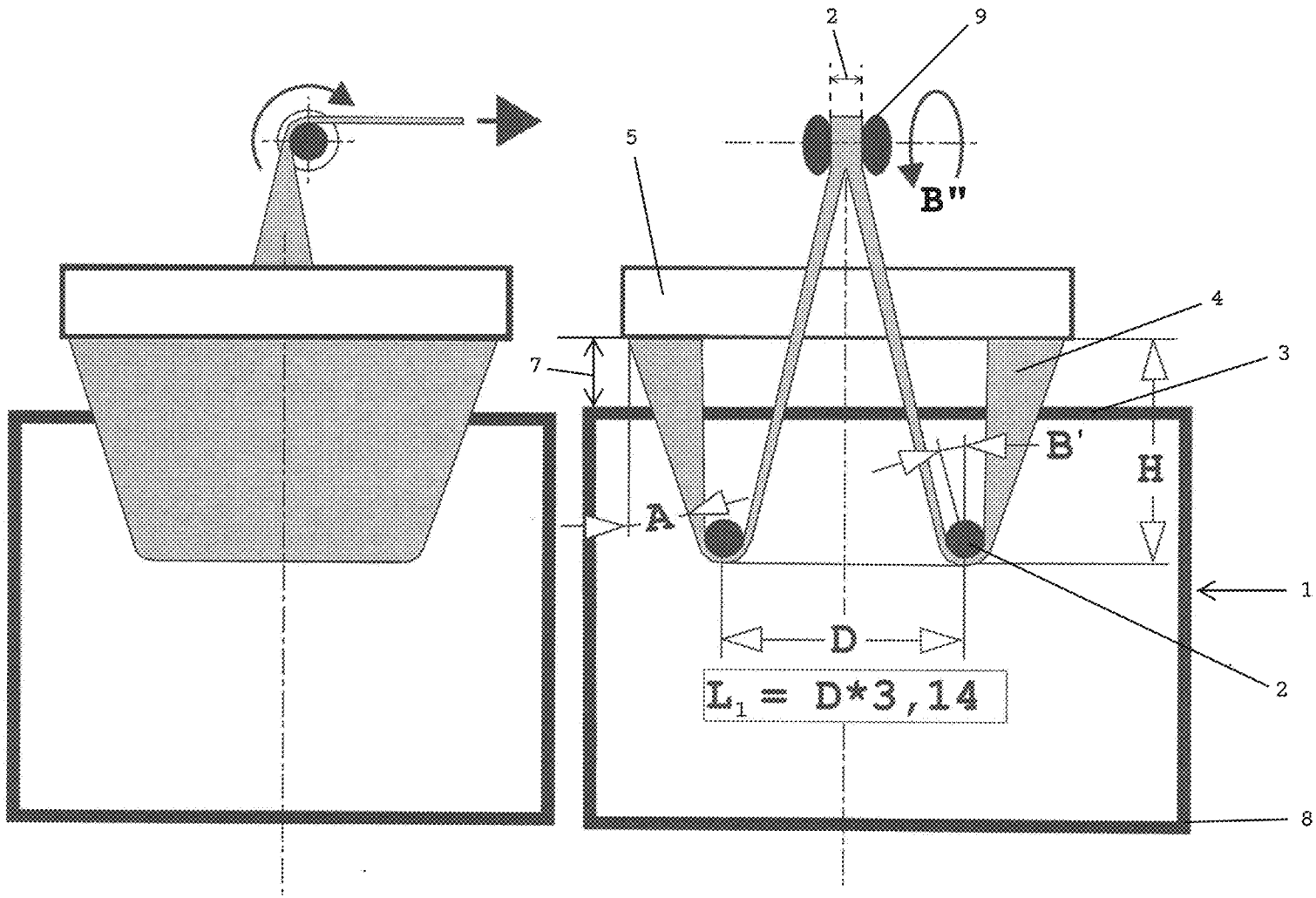
FIG. 2*c* shows a spinning tank system in combination with an annular spinning nozzle arrangement, wherein the annular extrudate curtain is deflected via a torus-shaped deflection device at a deflection angle (B') and the deflected extrudate curtain is withdrawn from the spinning bath in a vertically upward direction along the central axis of the annular nozzle arrangement.

FIG. 2*c* shows a spinning tank system in combination with an annular spinning nozzle arrangement, wherein the annular extrudate curtain is deflected via a torus-shaped deflection device at a deflection angle (B') and the deflected extrudate curtain is withdrawn from the spinning bath in a vertically upward direction along the central axis of the annular nozzle arrangement. Above the annular nozzle arrangement and thus outside the spinning bath, the extrudate curtain may be bundled at an advantageously large deflection angle (B"). As the bundling and/or deflection processes are conducted outside the spinning bath liquid, the bundling and/or deflection processes may also be realized with freely rotating rollers, thus avoiding any slide friction between extrudate bundle and deflection device. Another embodiment of a bundling process conducted above the annular spinning nozzle arrangement is, analogously to the use of a spinning funnel, the provision of a torus-shaped bundling device and optionally the downstream installation of a freely rotating deflection roller. With the use of a system according to FIG. 2*c*, many disadvantages associated with a system according to FIG. 2*b* can be overcome. Compared to the annular nozzle arrangement according to FIG. 2*b*, the nozzle draft angle (A) is greatly decreased, thus facilitating a gentler drawing from the nozzle. Even with the use of large nozzle arrangements, the normal distance (H) can be kept small, thus allowing for manual accessibility of the deflection device. Bundling of the extrudate curtain in the spinning bath is not required. Typical for the tank system with annular nozzle arrangement and a torus-shaped deflection device in the spinning bath are rather small deflection angles (B) with a large deflection width (L).

Figure 3A:
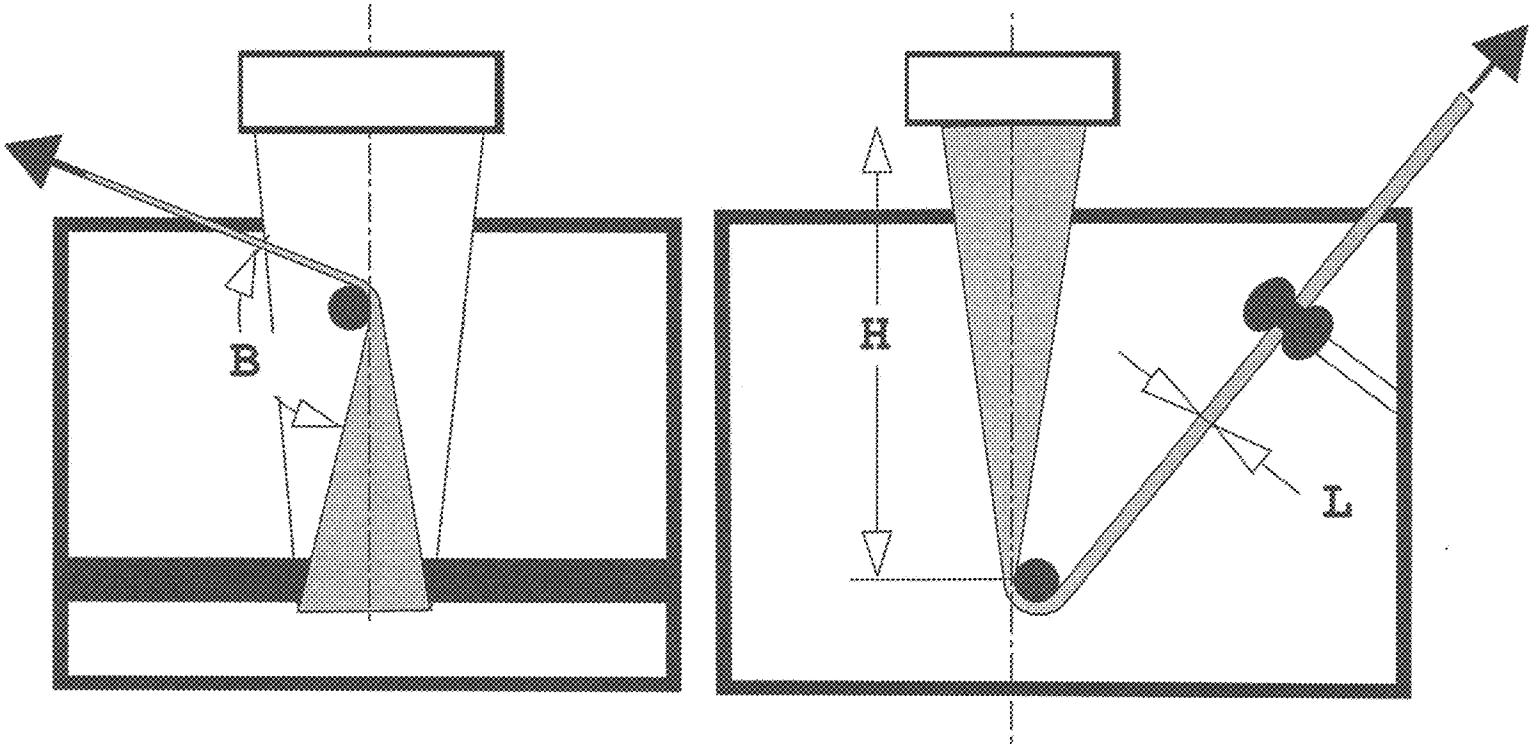
FIG. 3*a* shows a tank system with deflection and bundling. A spinning curtain having a width L and a deflection angle B is deflected at the bundling device.

FIG. 3*a* shows a comparative example in the form of a spinning tank system in combination with a rectangular nozzle arrangement, wherein the extrudate curtain in the spinning tank is deflected 2-fold. The first (as viewed in the direction of production) deflection process is implemented analogously to the embodiment according to FIG. 2*a*, while the second deflection provides for another change in direction and simultaneously for bundling the extrudate curtain to form an extrudate strand. Typical for this deflection system with bundling process are rather moderate deflection angles (B) with a small deflection width (L) due to bundling. In this case, the strong bundling required the selection of a high load number of 20. The spinning behavior was not satisfactory.

Figure 3B:
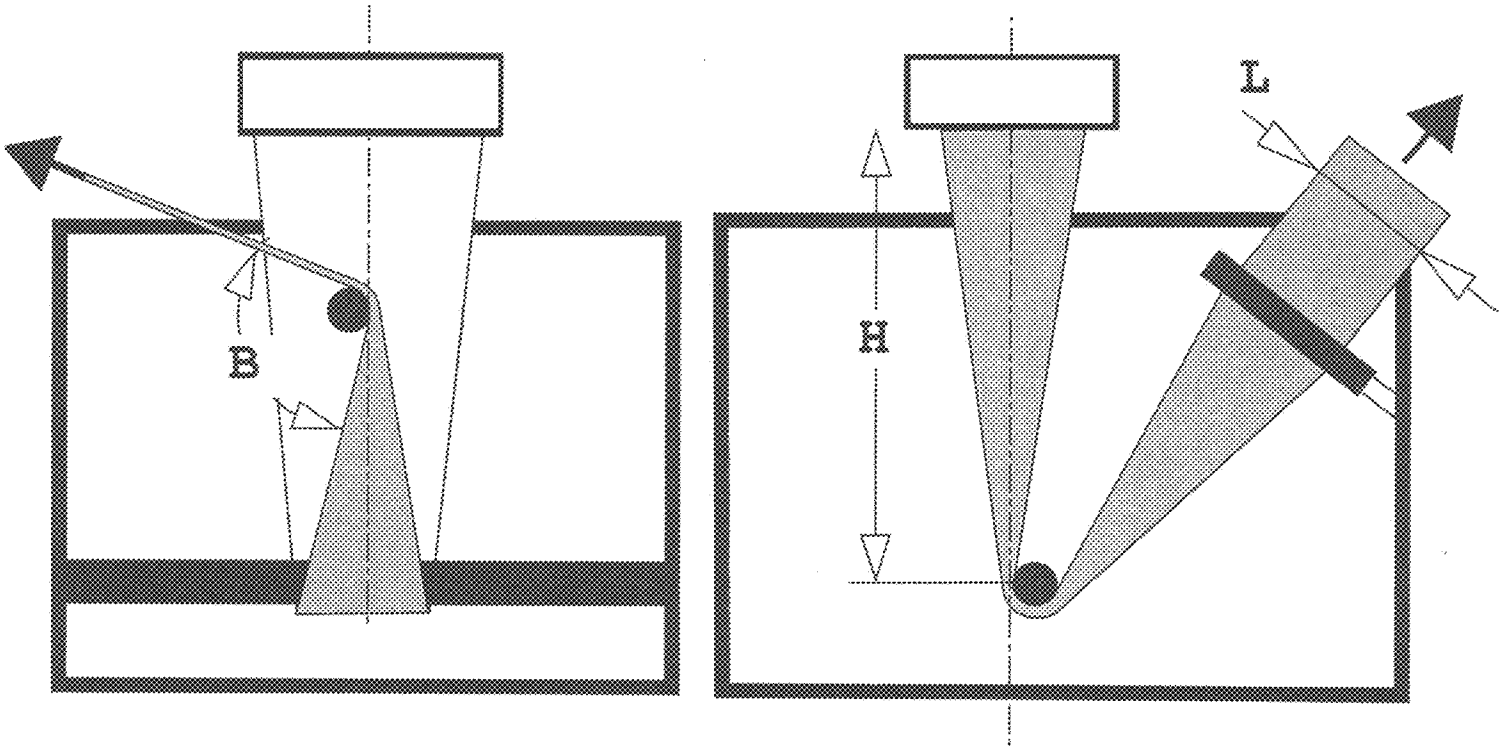
FIG. 3*b* shows a tank system having two deflection devices, wherein (in contrast to FIG. 3*a*) no bundling is performed at the second deflection device. At said second deflection device, a spinning curtain having a width L and a deflection angle B is deflected.
Figure 3C:
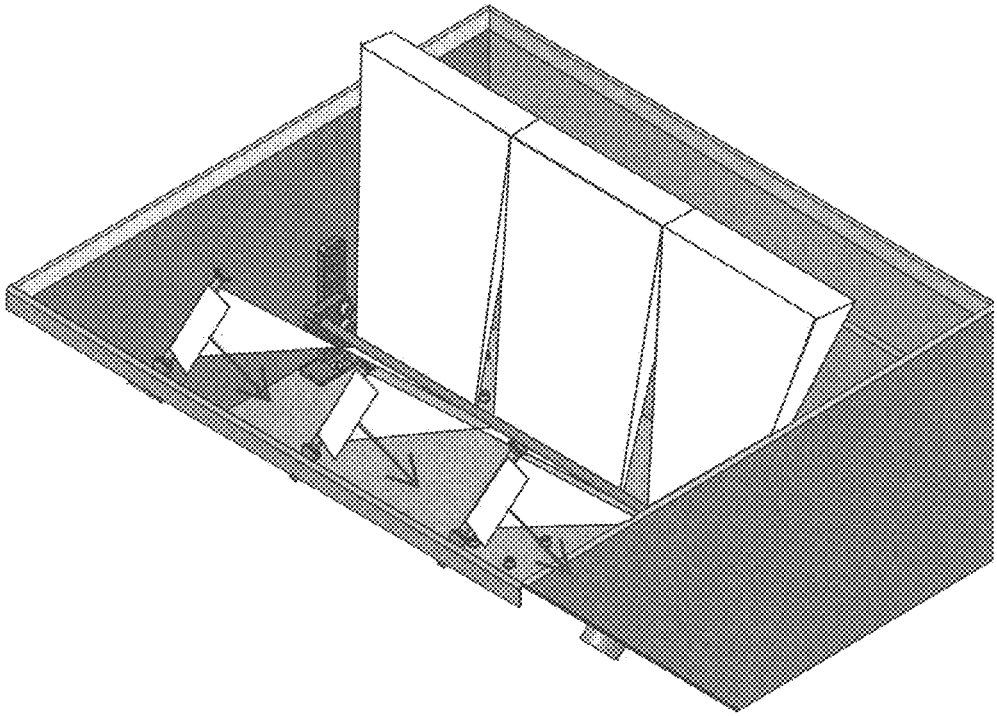
FIG. 3*c* shows a tank system with three spinning curtains which are deflected at a common deflection device in the tank and at separate deflection devices at the edge of the tank, from which the bundles, as marked by the arrows, are drawn.

FIG. 3*b* shows a spinning tank system according to FIG. 3*a*, with the exception that the second deflection process was dimensioned based on a substantially smaller load number (no or little bundling). Owing to the increased length (L) of the deflection device, a highly satisfactory spinning behavior was achieved here (in contrast to the embodiment according to FIG. 3*a*.

Figure 4A:
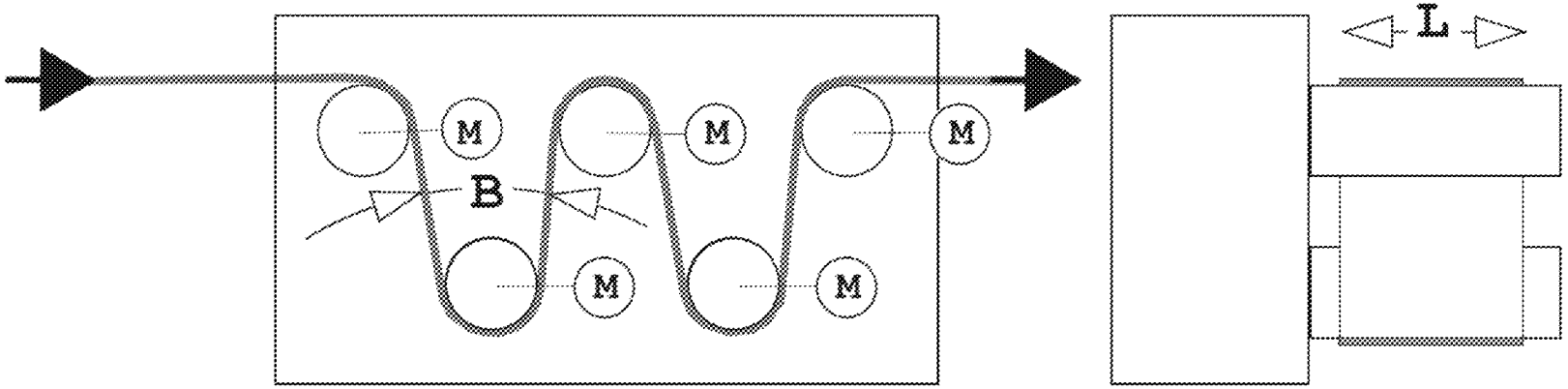
FIG. 4 shows a deflection device in a drawing mill having driven rollers denoted with "M", in top view (left) and lateral view (right). It may be provided that all rollers are driven (FIG. 4*a*) or that some of the rollers are driven (FIG. 4*b*). The arrow indicates the transport of the filament bundles. The bundles are deflected by an angle B (0° to 150°) at rollers. "L" denotes the width of the filament bundle at the roller.
Figure 4B:
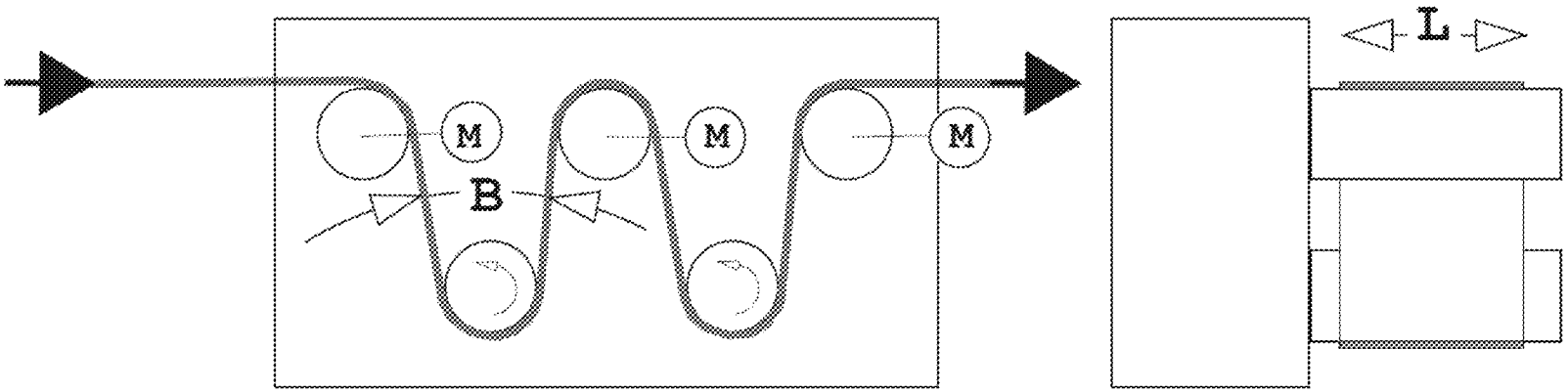

Upon exiting the coagulation bath, the bundles are transferred to a jointly conducted drawing and washing process via a drawing gear and a washing station, which may also be combined. The first drawing gear after the bath confers the drawing speed of the filaments in the spinning process. FIG. 4 shows a possible drawing gear, wherein 5 rollers, 3 with motors ("M" in the circle) are schematically depicted. Given a corresponding adaptation to the system, any number of rollers can be employed; e. g. a number of 1 to 60 would be conventional. In this instance, the bundles are deflected at the rollers at an angle B of 0° to 150°. Preferably, the width of the filament bundles according to Formula 1 is also maintained here, wherein Q may be higher than in the coagulation bath, e. g. 40 to 300. Either all or some of the rollers may be driven. All driven rollers may be driven jointly or separately. In case of a simultaneously conducted washing process, a different speed (with respect to at least the rotation speed of the roller surface, with the use of equally dimensioned rollers also the rotation speed of the rollers as a whole) is recommended, as the filaments lose solvent and shrink during the washing process. The shrinking process should be met with decreasing speeds in order to avoid tearing of the filaments. Non-driven rollers may be freely rotating rollers. The use of driven rollers results in static friction between the filaments and the roller, while the use of non-driven rollers results in slide friction between the filaments and the roller.

TABLE 1

| Figure | Example | Nozzle arrangement | Hole number LZ | Cellulose concentration $C_{cell}$ [%] | Drawing speed V [m/min] | Spinning bath system | Deflection angle in precipitation bath B [°] |
|---|---|---|---|---|---|---|---|
| 1 | 1 | Round nozzle | 12078 | 12 | 60 | Funnel | 165 |
| 2a | 2 | Rectang. nozzle | 34048 | 12 | 55 | Tank | 55 |
| 2b | 3 | Annular nozzle | 91680 | 13 | 30 | Tank | 35 |
| 2c | 4 | Annular nozzle | 91680 | 13 | 50 | Tank | 35 |
| 3a | 5 | Rectang. nozzle | 10808 | 12 | 60 | Tank | 95 |
| 3b | 6 | Rectang. nozzle | 10808 | 12 | 60 | Tank | 95 |

| Figure | Selected load number Q | Minimum deflection width required L [mm] | Selected deflection width L [mm] | Deflection | Deflection device | Titer dtex | Spinning behavior *) |
|---|---|---|---|---|---|---|---|
| 1 | 5.0 | 18.2 | 40 | wet | Discharge orifice | 1.3 | 2 |
| 2a | 5.0 | 280.6 | 400 | wet | Rigid straight rod | 1.3 | 1 |

TABLE 1-continued

| | | | | | | | |
|---|---|---|---|---|---|---|---|
| 2b | 12.0 | 71.4 | 100 | wet | Concavely bent rod (bundling) | 1.3 | 1-2 |
| 2c | 5.0 | 614.9 | 1,200 | wet | Rod (torus) | 1.3 | 1 |
| 3a | 20.0 | 21.1 | 25 | wet | Rigid ceramic spool | 1.3 | 2-3 |
| 3b | 5.0 | 84.3 | 120 | wet | Rigid rod | 1.3 | 1 |

*) Evaluation of spinning behavior:
1 = faultless operation, flawless quality
2 = minor malfunctions, tear-offs, adhesions
3 = recurring malfunctions
Comments:
FIG. 1: Hydrodynamic effects at the funnel discharge preclude higher drawing speeds.
FIG. 2b: L = stretched length of concave rod
FIG. 2c: L = stretched length of torus-shaped deflection device Alternatively and in parallel to the lyocell method with NMMO/water as a solvent, an ionic solution was prepared for producing the cellulose solution. The cellulose employed (type: Eucalyptus pulp) was suspended in desalinated water. Once the cellulose fibers were completely suspended in the water, the excess water was separated by filtration and the resulted pulp cake was compressed until a solids concentration of about 50% cellulose was obtained. Subsequently to the dehydration process, the pulp cake was guided across a needle roller and shredder for fraying. The resulting finely frayed wet cellulose was introduced in a continuous process into the aqueous ionic liquid 1-N-butyl-3-methylimidazolium chloride (BMIMCl) to obtain the pre-mix. Suitable devices for this purpose are ring layer mixers and/or turbulent mixers.

In the further course of the process, the resulting mixture of water, cellulose and BMIMCl was introduced into a continuously operating vertical kneading device (type: Reactotherm by Buss-SMS-Canzler GmbH) in order to prepare the cellulose solution. In the different reactor zones and method steps, similar kneading and reactor devices as well as any types of extruders, high-viscosity thin-film processors, stirred-tank reactors and/or disk reactors may be used for preparing the cellulose solutions, either individually or in combination. Owing to its intense mixing and kneading action, the present, vertically implemented Reactotherm kneading device allowed for the lump-free and continuous production of the cellulose solution. Treatment periods of 20 to 80 in the individual reactor zones minutes resulted in a complete dissolution of the cellulose.

To ensure secure process management, further stabilizers for stabilizing the solvents and preventing cellulose degradation were added to the aqueous mixture of ionic liquid and cellulose prior to the conversion from pre-mix into cellulose solution. Under application of temperature, negative pressure (vacuum) and shearing, the continuously produced pre-mix was converted into a highly viscoelastic solution. The temperatures applied in the individual method steps varied between 85° C. and 150° C., wherein the removal of excess water was conducted under reduced pressure of between 10 and 150 mbar. The shearing rates applied for homogenizing the pre-mix were within a range of of 20 to 200 rpm, while maintaining the settings for shearing power and torque, thus ensuring the dissolution of cellulose in the ionic fluid. The highly viscous cellulose solution obtained in this manner was subjected to additional process steps, such as degassing and filtration, prior to the spinning process. In order to adjust the corresponding cellulose spinning mass quality, the solution was additionally fed to one or more high-viscosity heat exchangers (type: Sulzer SMR/SMXL), which had been adapted to the respective method steps. In addition to temperature regulation, these devices particularly also serve to adjust the desired spinning viscosity as well as the degree of polymerization of the cellulose. These heat exchangers thus provided efficient temperature regulation, such as cooling or heating, of the highly viscous cellulose solution as they facilitated an effective mixing process and a controlled transfer of heat.

The spinning process for forming filaments from the cellulose solution as well as other processing steps were carried out according to the present invention, wherein the spinning solution was fed via a spinning pump to a heated spinning block, consisting of spinning nozzle filter, distributor plates and the spinning nozzle. The spinning temperatures were within a range of of 85° C. to 150° C., preferably within a range of 95° C. to 115° C. After the step of preparing the solution, short residence times under elevated temperatures were maintained in the process system in order to adapt the cellulose solution with respect to the processing speed and undesired cellulose degradation.

The spinning method employed has been described according to the present invention and is usually referred to as dry-wet spinning method, wherein the variable, height-adjustable air gap is arranged between the spinning nozzle and the aqueous coagulation bath containing the ionic liquid. The gas stream fed into the air gap and thus passing through the filaments is injected in a conditioned manner and may consist of conditioned air or any other inert spinning gas. According to the present invention, the filaments are guided through the coagulation bath, withdrawn from the bath and subsequently transferred to further treatment steps, as described above. The parameters and product characteristics of the experiments conducted with BMIMCl and NMMO as solvents are summarized in Table 2.

TABLE 2

| | | Ionic liquid (BMIMC1) | N-methyl-morpholine-N-oxide (NMMO) |
|---|---|---|---|
| Pulp | | Eucalyptus | Eucalyptus |
| DP-Cuoaxam | [—] | 535 | 646 |
| α cellulose content | [%] | 95.2 | 94.8 |
| Carboxyl group content | [μmol/g] | 17 | 27 |
| Carbonyl group content | [μmol/g] | 23 | 29 |

TABLE 2-continued

| | | Ionic liquid (BMIMC1) | N-methyl-morpholine-N-oxide (NMMO) |
|---|---|---|---|
| Ash content | [%] | 0.4 | 0.2 |
| Degree of whiteness WCIE | [—] | 82 | 84 |
| Fiber data | | | |
| Solids content cellulose in ionic liquid | [%] | 13.27 | 12.8 |
| DP-Cuoxam | [—] | 521 | 584 |
| Zero shearing viscosity at 85° C. | [Pa · s] | 39.720 | 19.250 |
| Spinning mass temperature | [° C.] | 102 | 95 |
| Nozzle hole diameter | [μ] | 90 | 90 |
| Spinning pressure | [bar] | 37 | 27 |
| Air gap | [mm] | 43 | 38 |
| Spinning bath temperature | [° C.] | 20 | 18 |
| Fiber linear density | [dtex] | 1.63 | 1.71 |
| Breaking load, conditioned | [cN/tex] | 51.2 | 41.0 |
| Extension, conditioned | [%] | 13.9 | 15.2 |
| Wet modulus | [cN/tex] | 297 | 185 |
| Wet abrasion number | [U] | 54 | 38 |

The invention claimed is:

1. A method for producing solid cellulose filaments from a cellulosic fluid, the method comprising the steps of: extruding said fluid through a plurality of extrusion openings, whereby fluid filaments are formed; and solidifying said filaments in a coagulation bath; wherein the filaments are bundled and deflected as a bundle in the coagulation bath in order to be drawn from the coagulation bath above the coagulation bath level, the bundle of filaments occupies a deflection width L on a deflection device, the deflection width L being controlled according to the formula:

$$L>(2\times LZ\times\cos(B/2)\times v^{2,5})/(10\times c_{cell}^{0,5}\times Q),$$

wherein L is the deflection width of the bundle in mm, LZ is the number of extrusion openings, B is the deflection angle (calculated as 180° minus the wrap angle of the filaments around the deflection device in angular degrees), v is the drawing speed of the filaments in meters per second, $c_{cell}$ is the cellulose concentration of the extruded fluid in % by mass and Q is a dimensionless load number, wherein Q is 15 or lower.

2. A device for conducting the method according to claim 1, the device comprising: an extrusion plate having a plurality of extrusion openings; a collection container for taking up a coagulation bath; a deflection device arranged in the collection container for deflecting a filament bundle from the collection container; and a bundling device which determines a deflection width L occupied by the filament bundle on the deflection device; wherein the filament bundle occupies a deflection width L on the deflection device which meets the requirements of the formula:

$$L>(2\times LZ\times\cos(B/2)\times v^{2,5})/(10\times c_{cell}^{0,5}\times Q),$$

wherein L, LZ, B, v, $c_{cell}$ and Q are as defined in claim 1, Q is 15 or lower and v is at least 35 m/min.

3. The device according to claim 2, further including a gas gap arranged between the extrusion openings and the collection container.

4. The method according to claim 1, characterized in that Q is 12 or lower, and/or that Q is 2 or larger.

5. The method according to claim 1, characterized in that the number of extrusion openings LZ is 2,000 or more, and/or that LZ is 500,000 or less.

6. The method according to claim 1, characterized in that the deflection angle B is an angle of 10° to 90°.

7. The method according to claim 1, characterized in that the drawing speed v is 36 m/min or higher, and/or 200 m/min or lower.

8. The method according to claim 1, characterized in that the cellulose concentration cell of the extruded fluid is from 4% to 23% (all percentages are given in % by mass) and/or wherein the extruded fluid contains cellulose, NMMO and water, or cellulose, an organic cationic solvent and water.

9. The method according to claim 1, characterized in that a gas stream is injected into the gas gap, or to which end a blower is provided in the device.

10. The method according to claim 9, wherein the gas stream has a temperature of 5° C. to 65° C.

11. The method according to claim 1, wherein the extrusion openings are arranged in one of a longitudinal shape, a rectangular shape, a curved shape, an annular shape and a ring segment shape.

12. The method of claim 11, wherein the longitudinal shape has a ratio of length to width from 100:1 to 2:1.

13. The method according to claim 1, characterized by the following further steps: withdrawing the coagulated filaments from the coagulation bath; deflecting the filaments outside the coagulation bath, either with or without further bundling with further coagulated filaments; feeding the filaments onto a drawing gear and/or a stretching device and subsequently conveying the filaments/extrudates to a filament reception unit; washing and drying the filaments.

14. The method according to claim 13, wherein further steps are provided: finishing, dyeing, cross-linking, sonication, cutting and/or reeling of the filaments/extrudates.

15. The method according to claim 1, characterized in that the extrusion openings have a diameter of 30 μm to 200 μm.

16. The method according to claim 1, characterized in that the extrusion openings are arranged within a length LL and the deflection width L is at least 80% of the length LL.

17. The method according to claim 1, characterized in that the bundle of filaments occupies a deflection width $L_{outside}$ on a deflection device provided outside the coagulation bath, which is controlled according to the formula:

$$L>(2\times LZ\times\cos(B/2)\times v^{2,5})/(10\times c_{cell}^{0,5}\times Q),$$

wherein $L_{outside}$ is the deflection width of the bundle in mm, LZ is the number of extrusion openings, B is the deflection angle (calculated as 180° minus the wrap angle of the filaments around the deflection device in angular degrees), v is the speed of the filaments in meters per second, $c_{cell}$ is the cellulose concentration of the extruded fluid in % by mass and Q is a dimensionless load number, wherein Q is 300 or lower.

18. The method of claim 17, wherein said bundle of filaments occupies the deflection width $L_{outside}$ on at least in a first deflection process after the filaments have emerged from the coagulation bath and/or on at least in a deflection process conducted in a drawing gear.

19. The method according to claim 1, further including passing said fluid filaments through a gas gap.

20. A method for producing solid cellulose filaments from a cellulosic fluid, the method comprising the steps of: extruding said fluid through a plurality of extrusion openings, whereby fluid filaments are formed; solidifying said filaments in a coagulation bath; wherein the filaments are bundled and deflected as a bundle in the coagulation bath in order to be drawn from the coagulation bath above the coagulation bath level; the extrusion openings are arranged within a length LL and the bundle of filaments resting on a deflection device occupies a deflection width L which is at least 80% of the length LL; and the bundle of filaments occupies a deflection width $L_{outside}$ on a deflection device provided outside the coagulation bath, which is controlled according to the formula:

$$L>(2\times LZ\times\cos(B/2)\times v^{2,5})/(10\times c_{cell}^{0,5}\times Q),$$

wherein $L_{outside}$ is the deflection width of the bundle in mm, LZ is the number of extrusion openings, B is the deflection angle (calculated as 180° minus the wrap angle of the filaments around the deflection device in angular degrees), v is the speed of the filaments in meters per second, $c_{cell}$ is the cellulose concentration of the extruded fluid in % by mass and Q is a dimensionless load number, wherein Q is 300 or lower.

21. A device for conducting a method according to claim 20, the device comprising: an extrusion plate having a plurality of extrusion openings; a collection container for taking up a coagulation bath; a deflection device arranged in the collection container for deflecting a filament bundle from the collection container; and a bundling device which determines a deflection width L occupied by the filament bundle on the deflection device; the extrusion openings are arranged within a length LL and the bundle of filaments occupies a deflection width L on the deflection device which is at least 80% of the length LL, and the bundle of filaments occupies a deflection width $L_{outside}$ on a deflection device provided outside the coagulation bath, which is controlled according to the formula:

$$L>(2\times LZ\times\cos(B/2)\times v^{2,5})/(10\times c_{cell}^{0,5}\times Q),$$

wherein $L_{outside}$ is the deflection width of the bundle in mm, LZ is the number of extrusion openings, B is the deflection angle (calculated as 180° minus the wrap angle of the filaments around the deflection device in angular degrees), v is the speed of the filaments in meters per second, $c_{cell}$ is the cellulose concentration of the extruded fluid in % by mass and Q is a dimensionless load number, wherein Q is 300 or lower, and v is at least 35 m/min.

22. The device according to claim 21, further including a gas gap arranged between the extrusion openings and the collection container.

23. The device of claim 21, wherein bundle of filaments occupies the deflection width $L_{outside}$ on at least in a first deflection process after the filaments have emerged from the coagulation bath and/or on at least in a deflection process conducted in a drawing gear.

24. The method according to claim 20, further including passing said fluid filaments through a gas gap.

25. The method of claim 20, wherein said bundle of filaments occupies the deflection width $L_{outside}$ on at least in a first deflection process after the filaments have emerged from the coagulation bath and/or on at least in a deflection process conducted in a drawing gear.

* * * * *